US005441627A

United States Patent [19]

Kato et al.

[11] Patent Number: 5,441,627

[45] Date of Patent: Aug. 15, 1995

[54] METAL FOIL MANUFACTURING METHOD AND AN ANODIZED FILM FORMING APPARATUS USED THEREFOR

[75] Inventors: Hitoshi Kato, Utsunomiya; Toshio Horie, Tokyo; Koichi Ashizawa, Yokohama, all of Japan

[73] Assignees: The Furukawa Electric Co., Ltd; Circuit Foil Japan Co., Ltd., both of Tokyo, Japan

[21] Appl. No.: 247,144

[22] Filed: May 20, 1994

[30] Foreign Application Priority Data

| | | | |
|---|---|---|---|
| Jun. 2, 1993 | [JP] | Japan | 5-132017 |
| Sep. 8, 1993 | [JP] | Japan | 5-222919 |
| Dec. 6, 1993 | [JP] | Japan | 5-305345 |
| Dec. 24, 1993 | [JP] | Japan | 5-327584 |

[51] Int. Cl.[6] ..... C25D 1/20; C25C 7/08

[52] U.S. Cl. ..... 205/77; 204/215; 205/143; 205/151

[58] Field of Search ..... 205/76, 77, 143, 151, 205/916; 204/215, 227, 268

[56] References Cited

FOREIGN PATENT DOCUMENTS 217828 1/1985 Germany .
211093 10/1985 Japan .

*Primary Examiner*—John Niebling
*Assistant Examiner*—Edna Wong
*Attorney, Agent, or Firm*—Frishauf, Holtz, Goodman & Woodward

[57] ABSTRACT

There is provided a metal foil manufacturing method, in which a metal foil is manufactured by forming a thin metal layer by electrodepositing a metal on the surface of a cathode through an electrolytic reaction, and then separating the thin metal layer from the cathode surface. In doing this, an anodized film forming apparatus is mounted on an exposed surface of the cathode exposed after the separation of the metal layer, and is operated to subject the exposed surface of the cathode continuously or intermittently to electrolytic oxidation, thereby forming an anodized film on the exposed surface. The apparatus comprises electrolytic agent retaining means for retaining an electrolytic agent for anodization in contact with the exposed surface of the cathode, an electrode located in the electrolytic agent in the retaining means and supplied with an electrolytic current at a potential lower than the operating potential of the cathode, and electrolytic agent supply means for supplying the electrolytic agent to the electrolytic agent retaining means.

21 Claims, 8 Drawing Sheets

METAL FOIL MANUFACTURING METHOD AND AN ANODIZED FILM FORMING APPARATUS USED THEREFOR

BACKGROUND OF THE INVENTION

1. Field of the Invention

The present invention relates to a metal foil manufacturing method and an anodized film forming apparatus used therefor, and more specifically, to a metal foil manufacturing method, in which an anode and a cathode are arranged in an electrolytic cell filled with an electrolytic solution containing predetermined metal ions, current is supplied between the anode and the cathode to advance an electrolytic reaction, thereby electrodepositing a specified metal to form a thin metal layer on the surface of the cathode, and the thin metal layer is then separated from the cathode surface to obtain a metal foil, such as an electrolytic copper foil, whereby the working life of the cathode is lengthened and the properties of the obtained metal foil are improved by forming an anodized film on the cathode surface, and an apparatus for forming the anodized film.

2. Description of the Prior Art

In general, foils of metals such as iron, copper, chromium, nickel, etc., or foils of alloys of these metals are manufactured in the following manner. A specified electrolytic solution containing ions of any of these metals is supplied to cause an electrolytic reaction between an insoluble cathode and an also insoluble anode. By doing this, the target metal is electrodeposited to a desired thickness on the surface of the cathode, thereby forming a thin metal layer. Then, the formed metal layer is separated from the cathode surface. The cathode used in this case is in the form of a drum or plate.

Usually, an apparatus having the construction shown in FIG. 1 is used for the manufacture of the metal foils.

Referring to FIG. 1, an insoluble anode 2 formed of, e.g., lead, and a drum-shaped, insoluble rotating cathode 3 formed of, e.g., titanium, stainless steel, or chromium-plated stainless steel, are opposed to each other across a gap 4 with a predetermined width in an electrolytic cell 1. The cell 1 is filled with an electrolytic solution 5 of a specified type having a predetermined concentration.

The electrolytic solution 5 is fed into the gap 4 by means of a distributor through an electrolyte feed opening 6 as the rotating cathode 3 is rotated in the direction indicated by arrow p. An electrolytic reaction is advanced by supplying a current with a predetermined current density between the anode 2 and the rotating cathode 3.

A metal is electrodeposited to a predetermined thickness on a surface 3*a* of the rotating cathode 3. A thin layer of the electrodeposited metal is separated as a metal foil from the cathode surface 3*a*, and the resulting metal foil 7 is wound by means of a coiler 9 with the aid of guide rollers 8*a* and 8*b*, whereupon a desired metal foil is manufactured in succession.

When the aforementioned conventional apparatus is operated for a long period of time, the surface 3*a* of the cathode 3 suffers metal fatigue as the electrodeposition of the metal and the separation of the metal foil 7 are repeated. Moreover, the bare surface 3*a* of the cathode 3, exposed after being cleared of the metal foil 7, undergoes many hours of exposure to an atmosphere which involves oxygen gas generated from the anode 2 or splashes of the electrolytic solution 5, whereby it is oxidized irregularly. In consequence, a nonuniform anodized film with uneven thickness is formed on the surface 3*a*. When the metal is electrodeposited on the rotating cathode 3 with the nonuniform anodized film thereon, the metal foil 7 obtained is subject to tissue defects, such as surface unevenness, pinholes, etc.

Conventionally, in order to solve this problem, the active surface of the rotating cathode 3 is exposed in the following manner. After the apparatus is continuously operated for a predetermined period of time, the surface 3*a* of the cathode 3 is buffed by means of a buff 10 held against it and rotating in the direction indicated by arrow q, as shown in FIG. 1. By doing this, the nonuniform anodized film on the surface 3*a* is removed. This operation is periodically performed to keep the quality of the manufactured metal foils fixed. In manufacturing electrolytic copper foils, buffing is usually carried out every 48 hours or thereabout, for example.

In order to maintain the quality of the metal foils, however, it is essential to effect the buffing in predetermined cycles without suspending the operation of the apparatus. Therefore, those metal foils which are produced in the course of the buffing operation have no satisfactory properties for products, and thus they are bound to be abandoned. Accordingly, the productivity of the metal foils is lowered.

Foreign matters, such as abrasive powder and buff pieces, are produced during the buffing operation. In some cases, these foreign matters get into the electrolytic solution, making the resulting metal foils defective.

Moreover, the cathode surface, especially each end portion thereof, is worn by the buffing, so that the working life of the cathode is shortened. Thus, the cathode must be replaced frequently, resulting in an increase in manufacturing cost.

Described in DD 217 828A1, on the other hand, is a method in which a cathode of titanium or a titanium alloy used for the manufacture of a copper foil is anodized to form an anodized film on the cathode surface.

According to this method, part or whole of the cathode is immersed in an electrolytic solution, such as sulfuric acid, and the cathode is subjected to 10 to 60 minutes of anodization under conditions including an electrolytic voltage of 15 to 40 V and current density of 50 to 300 $mA/dm^2$.

However, the description of this prior art method indicates only the way the copper foil is manufactured by putting the anodized cathode into an electrolytic cell for copper foil manufacture after anodization of the cathode. In continuously manufacturing the copper foil by utilizing this prior art method, the process of copper foil manufacture must inevitably be suspended while the cathode surface is anodized. In other words, an elongate copper foil cannot be continuously produced with high efficiency according to the prior art method.

OBJECTS AND SUMMARY OF THE INVENTION

An object of the present invention is to provide a method of forming an anodized film of a uniform thickness, such that electrodeposition of a metal on an exposed surface of a cathode cannot be hindered, on the cathode surface cleared of a metal foil without suspending the operation of a metal foil manufacturing apparatus.

Another object of the invention is to provide a method of manufacturing an elongated metal foil free from tissue defects, such as surface unevenness, pinholes, etc., and having good mechanical properties, for a long period of time.

Still another object of the invention is to provide a method in which the frequency of buffing the surface of a cathode can be reduced so that the working life of the cathode is longer.

Accordingly, a further object of the invention is to provide a method of manufacturing a high-quality elongated metal foil at low cost and with high productivity.

An additional object of the invention is to provide an anodized film forming apparatus which is mounted on the surface of a cathode and can form an anodized film continuously or intermittently on the cathode surface without suspending the operation of a metal foil manufacturing apparatus.

In order to achieve the above objects, according to the present invention, there is provided a metal foil manufacturing method which comprises: a process for supplying current between an anode and a cathode immersed in an electrolytic solution, thereby causing an electrolytic reaction; a process for electrodepositing a metal on the surface of the cathode by means of the electrolytic reaction, thereby continuously forming a thin metal layer; and a process for separating the thin metal layer from the cathode surface, thereby continuously manufacturing a metal foil, characterized in that: an anodized film forming apparatus is mounted on the cathode surface exposed after being cleared of the thin metal layer; and the exposed cathode surface is subjected continuously or intermittently to electrolytic oxidation by means of the anodized film forming apparatus capable of effecting anodization without suspending the manufacture of the metal foil, whereby an anodized film is formed on the exposed surface.

According to the present invention, moreover, there is provided an anodized film forming apparatus, which is mounted on an exposed surface of a cathode exposed as a thin metal layer, formed on the cathode surface by an electrolytic reaction caused by supplying current between an anode and the cathode immersed in an electrolytic solution, is separated from the cathode surface, and can form an anodized film continuously or intermittently by subjecting the exposed surface of the cathode to electrolytic oxidation, the apparatus comprising: retaining means for retaining an electrolytic agent used for the electrolytic oxidation so that the electrolytic agent is in contact with the exposed surface of the cathode; an electrode located in the retaining means and facing the exposed surface of the cathode; and supply means for supplying the electrolytic agent to the retaining means, the apparatus being operated so that the operating potential of the anode is higher than that of the cathode, and that the operating potential of the cathode is higher than that of the electrode.

DETAILED DESCRIPTION OF THE INVENTION

An uniform anodized film formed on an exposed surface of a cathode has corrosion resistance by itself. Accordingly, the anodized film serves as a protective film which can prevent a nonuniform oxide film from being formed on the exposed surface of the cathode after separation of a metal foil, even when exposed to oxygen gas generated from the anode or splashes of an electrolytic solution for long periods in the progress of an electrolytic reaction during the manufacture of the metal foil. Thus, the manufactured metal foil can be effectively prevented from suffering tissue defects, such as surface unevenness, pinholes, etc.

Since the anodized film has good separability from a thin metal layer formed thereon, it can effectively restrain metal fatigue of the cathode surface which is caused when electrodeposition of metal on the cathode surface and separation of the metal foil from the cathode surface are repeated. Thus, it is possible to prevent local breakage of the cathode surface which is sometimes the case with a cathode without any anodized film thereon.

Thus, according to a method of the present invention, the very thin, uniform anodized film is formed on the surface of the cathode continuously in an on-line system or intermittently as required, whereby the surface of the cathode can be kept stable and uniform for a long period of time. In contrast with the conventional case, therefore, buffing need not be executed in short cycles.

The anodized film is formed by continuously or intermittently operating an anodized film forming apparatus (mentioned later) which is mounted on the surface portion of the cathode exposed after the separation of the metal foil.

Figure 1:
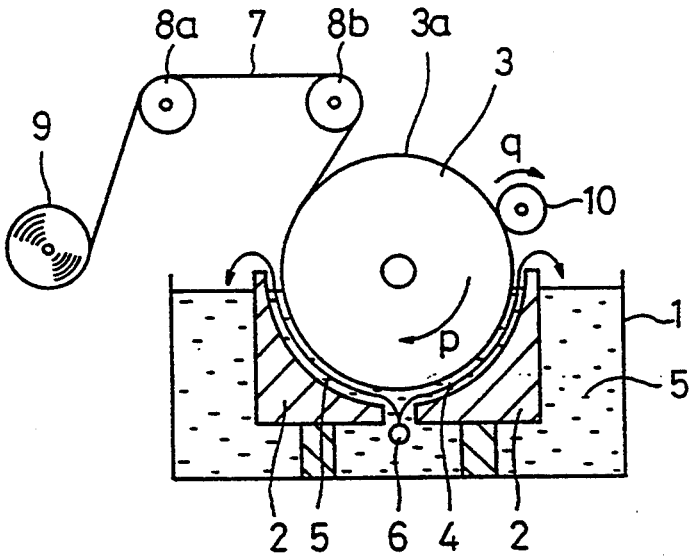
FIG. 1 (PRIOR ART)
FIG. 1 is a sectional view showing a prior art example of a metal foil manufacturing apparatus.
Figure 2:
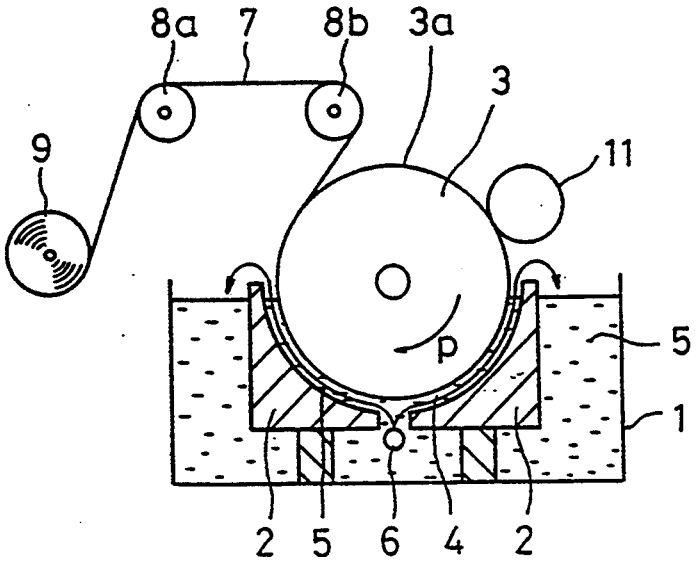
FIG. 2 is a sectional view showing an example of a metal foil manufacturing apparatus furnished with an anodized film forming apparatus according to the present invention.

In this case, as shown in FIG. 2, an anodized film forming apparatus 11 is mounted in a position short of the position where a surface 3*a* of a cathode 3 comes into contact with an electrolytic solution 5. Thus, electrodeposition of metal on the cathode 3 advances on an anodized film which is formed by operating the anodized film forming apparatus before the electrolytic reaction.

Figure 3:
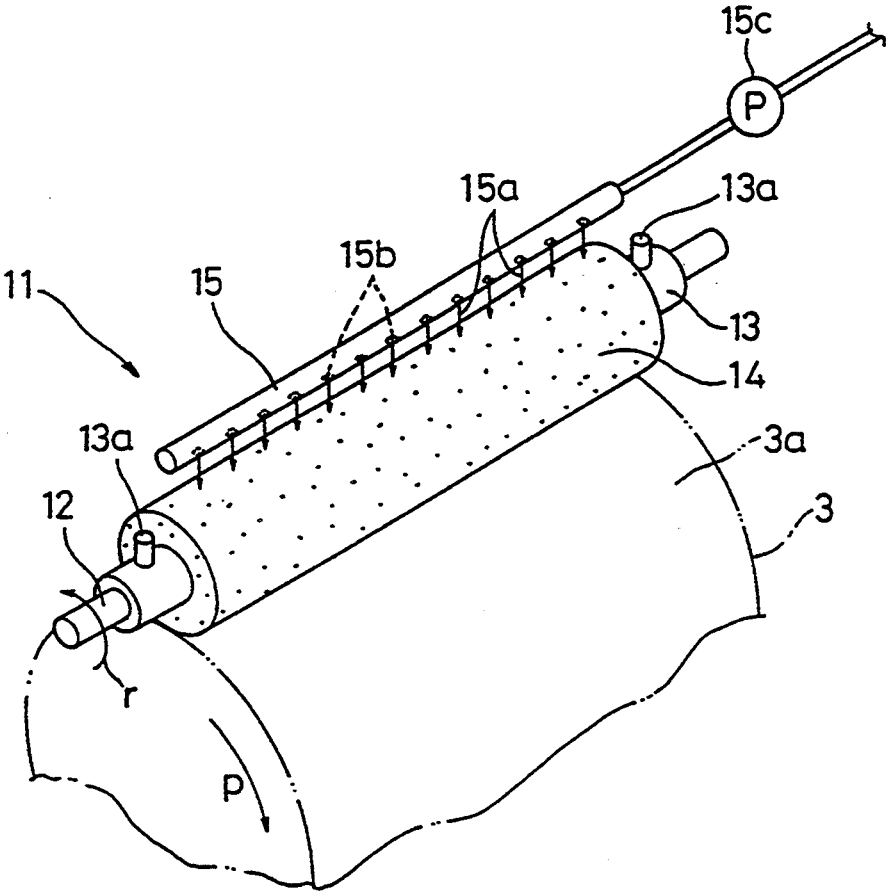
FIG. 3 is a cutaway perspective view showing an embodiment of the anodized film forming apparatus according to the invention.

FIG. 3 shows an embodiment of the anodized film forming apparatus of the present invention. In this case, the apparatus comprises a conductive roll 13, electrolytic agent retaining means 14, and a pipe or supply means 15. The roll 13, which has a center shaft 12 for mounting the apparatus, serves as an electrode which faces the cathode 3 during anodization. The retaining means 14, which surrounds the roll 13, retains an electrolytic agent 15*a* for anodization. The pipe 15 is used to supply the agent 15*a* to the retaining means 14. The retaining means 14 retains the electrolytic agent 15*a* supplied thereto, and brings it into contact with the surface 3*a* of the cathode 3. As the shaft 12 is rotatably supported by some means (not shown) in a manner such that the electrolytic agent retaining means 14 is in contact with the surface 3*a* of the rotating cathode 3 (indicated by imaginary line), the whole apparatus 11 is mounted on the surface 3*a* of the cathode 3, as shown in FIG. 2.

The conductive roll 13 may be formed of a corrosion-resisting material, such as titanium, nickel, chromium, copper, or stainless steel, or the same material coated with a conductive material, such as silver, silver alloy, gold, gold alloy, palladium, or palladium alloy, which is resistant to the electrolytic agent for anodization. Alternatively, the roll 13 may be formed of a roll member of a nonconductive plastic material, such as polypropylene or polyvinyl chloride, covered by a foil, wire, or mesh of a conductive, corrosion-resisting material, or of the same roll member plated, sprayed, or coated with a conductive, corrosion-resisting material. In short, a roll whose surface, at the least, is conductive and corrosion-resisting is used as an electrode for electrolytic oxidation of the cathode surface.

The electrolytic agent retaining means 14, which surrounds the conductive roll (electrode) 13, has permeability to liquid and proper elasticity. The retaining means 14 is formed by covering the conductive roll 13 with felt, nonwoven fabric, or split yarn of a material resistant to the electrolytic agent used, such as polyurethane, polyvinyl formal, or polyester.

The electrolytic agent retaining means 14 is overlain by the pipe 15 which is penetrated by a plurality of apertures 15*b* arranged in the axial direction of the retaining means 14. The pipe 15 is supplied with the specified electrolytic agent 15*a* by means of a pump 15*c*.

Although there are no special restrictions on the supplied electrolytic agent 15*a*, the agent should be one which is harmless to the manufacture of the metal foil when mixed with the electrolytic solution for the foil manufacture. Available for this purpose, for example, is an electrolytic solution actually used for the electrodeposition of the metal on the cathode surface in a metal foil manufacturing apparatus, more specifically, a water solution of copper sulfate for the manufacture of an electrolytic copper foil, a water solution of nickel sulfate or nickel sulfamate for the manufacture of a nickel foil, or a water solution of zinc sulfate for the manufacture of a zinc foil.

If the electrolytic agent 15*a* is the electrolytic solution actually used for the formation of the thin metal layer or an electrolytic solution with the same composition and a different ratio of components, its temperature should preferably be adjusted to a level higher than the deposition temperature of an electrolyte dissolved in the electrolytic solution.

If the solution temperature is lower than the deposition temperature, deposition of the electrolyte occurs, and the deposited electrolyte adheres to the surface of the cathode, thereby preventing anodization. As a result, the metal foil suffers local tissue microdefects, so that the mechanical characteristics of the metal foil are liable to be lowered, and bumpy tissues are easily formed on the surface of the metal foil.

Alternatively, the supplied electrolytic agent 15*a* may be an electrolytic solution free of any metal ions which can be electrodeposited on the surface 3*a* of the cathode 3. Examples of this electrolytic agent include acid aqueous solutions, such as water solutions of sulfuric acid, phosphoric acid, hydrochloric acid, etc., and neutral water solutions in which are dissolved sodium sulfate, potassium sulfate, sodium chloride, potassium chloride, etc. Among these solutions, the water solution of sulfuric acid is suited for the manufacture of a copper foil.

If the water solution of sulfuric acid is used as the electrolytic agent, its concentration should preferably be adjusted to 10 g/l or less for the following reason.

Referring to FIG. 2, the water solution of sulfuric acid used for the anodization of the surface of the cathode 3 flows down along the cathode surface to the liquid level of an electrolytic cell 1. Hardly any electrolytic current flows to the anodized surface of the cathode 3 which is situated below the apparatus, so that the anodized film is not grown. If the water solution of sulfuric acid with the concentration exceeding 10 g/l flows down to the cathode surface, therefore, it may possibly attack the thin, uniform anodized film formed expressly on the surface.

The supply means for the electrolytic agent for anodization is not limited to the pipe form. For this purpose, for example, the conductive roll 13 may be formed of a hollow member which has a number of apertures bored through the peripheral surface thereof. In this case, the electrolytic agent is fed into the hollow portion of the conductive roll 13 so that it can be supplied to the electrolytic agent retaining means 14 from inside through the peripheral apertures.

With use of the apparatus 11, the anodized film is formed on the cathode surface in the following manner.

First, the electrolytic agent retaining means 14 of the apparatus 11 is brought elastically into contact with the surface 3*a* of the cathode 3 rotating in the direction indicated by arrow p. Thereupon, the retaining means 14 automatically rotates in the direction indicated by arrow r in FIG. 3. In this state, the specified electrolytic agent 15*a* is supplied to the pipe (electrolytic agent supply means) 15.

The electrolytic agent 15*a* flows down through the apertures 15*b* onto the electrolytic agent retaining means 14, and penetrates into the retaining means 14 to be retained therein. As a result, the conductive roll (electrode for anodization) 13 and the surface 3*a* of the rotating cathode 3 are connected electrically to each other by means of the electrolytic agent 15*a*.

Subsequently, a pair of terminals 13*a* attached to the conductive roll 13 are connected to the (−) side of a power source (not shown), and the surface 3*a* of the rotating cathode 3 is connected to the (+) side of the power source. An electrolytic current is supplied between the roll 13 and the cathode surface 3*a*, whereby the surface 3*a* is anodized. In doing this, it is necessary to energize the conductive roll 13 so that the voltage obtained is lower than the voltage for the electrodeposition of the metal foil on the cathode surface, and to make the potential of the anode higher than that of the rotating cathode. If the potential of the cathode is made higher than that of the anode, metal foils may fail to be electrodeposited on the cathode surface, or if the current is supplied so that the potential of the conductive roll is higher than that of the cathode, the roll 13 and the surface 3*a* of the cathode 3 become (+) and (−) poles, respectively, and the cathode surface 3*a* cannot be anodized.

In this manner, an anodized film with a desired thickness is formed on the surface 3*a* of the rotating cathode 3.

In the case where at least the surface of the rotating cathode is formed of titanium, it is advisable to adjust the thickness of the anodized film to be formed to 1.4 to 140 angstroms. If the thickness of the film is greater than 140 angstroms, it starts to become an electrical insulator, and its insulating properties become nonuniform. Thus, the surface of metal foil obtained by the electrodeposition on the cathode surface is liable to be a surface having unevenness and pinholes, so that its mechanical characteristics, e.g., tensile strength, elongation, etc., are deteriorated. If the film is thinner than 1.4 angstroms, on the other hand, it cannot fulfill its function as a protective film protect the cathode surface against oxygen gas from the anode and splashes of the electrolytic solution, and the function to restrain the metal fatigue of the cathode surface which accompanies the repetition of the electrodeposition of the metal and separation of the thin metal layer.

The preferred thickness of the anodized film, which varies depending on the roughness of the titanium cathode surface, the homogeneity of the cathode tissue, or the thickness of the thin metal layer to be formed, is about 50 angstroms. The anodized film with the thickness of about 50 angstroms hardly has an anatase crystal structure which is peculiar to titanium oxide, and has a relatively epitaxial or amorphous film structure. Therefore, the thin metal layer formed on the film suffers no tissue microdefects at all, and the tissue is fine.

In forming the anodized film on the titanium surface of the rotating cathode, the roughness of the cathode surface should preferably be adjusted to 2.0 μm or less in terms of the Rz value prescribed by JISB0601. Although a specular surface is an optimum form, Rz of about 1.0 μm is enough.

The anodized film may be formed continuously or intermittently. Alternatively, continuous anodization may be combined with intermittent anodization.

The target metal is electrodeposited on the surface of the rotating cathode with the anodized film of the predetermined thickness thereon. When the resulting thin metal layer is separated, thereafter, part of the anodized film is separated accompanying the metal foil. As the electrodeposition and separation are repeated, therefore, the thickness of the anodized film is reduced little by little. In order to compensate for the reduction in the film thickness, the anodized film should be formed continuously or intermittently.

The constant-current method and constant-voltage method may be used for the anodization described above. According to the constant-voltage method in which the voltage is kept constant, out of these methods, the removal of the anodized film by the thin metal layer can be covered automatically and immediately when the metal layer is separated from the cathode surface, and the anodized film can be restrained from growing to an excessive thickness.

The thinner the thin metal layer formed on the surface of the cathode, the poorer the separability of the metal layer from the cathode surface is, and therefore, the thicker the anodized film portion taken away by the metal layer is. In this case, therefore, it is advisable to use the constant-voltage method.

The speed of the anodization and hence the thickness of the anodized film to be formed are nearly-settled depending rather on the electrolytic voltage used for the anodization than on the anodization time. It is known that the adopted electrolytic voltage and the thickness of the formed anodized film are in direct proportion to each other, and that the electrolytic voltage of 1 V corresponds to the film thickness of about 14 to 15 angstroms (see Japan Metallurgical Society Transactions Vol. 27, No. 4, pp. 296–298, 1988).

Since the preferred thickness of the anodized film ranges from 1.4 to 140 angstroms, as mentioned before, it is advisable to adjust the electrolytic voltage to 0.1 to 10 V when the constant-voltage method is used.

Figure 4:
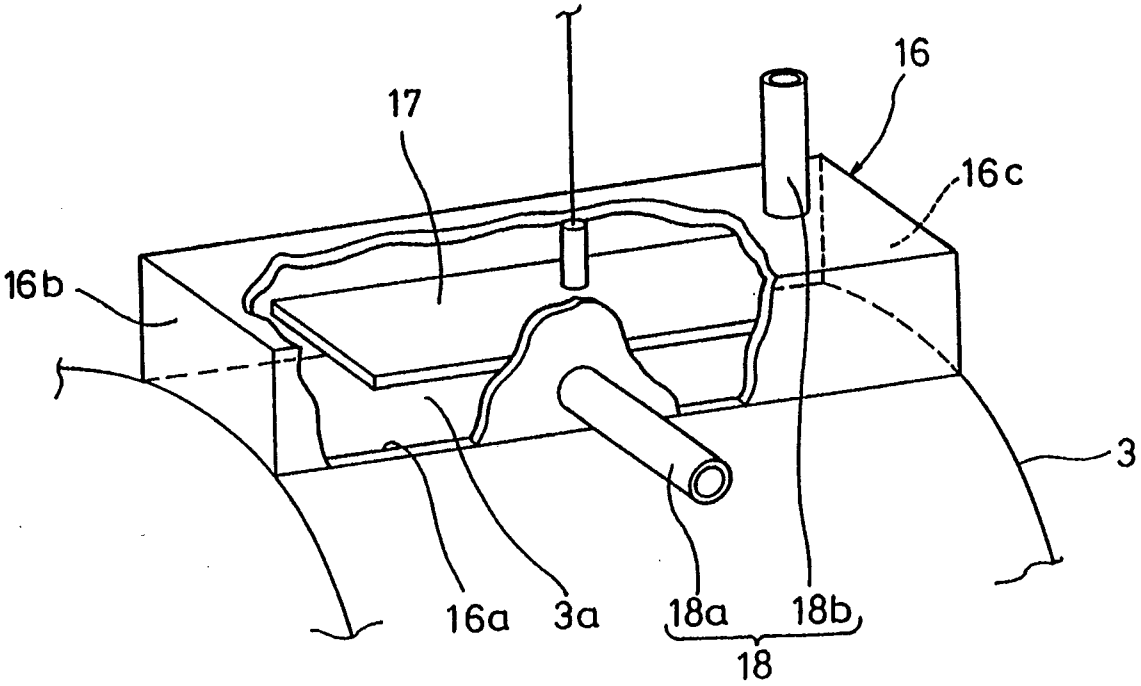
FIG. 4 is a cutaway perspective view showing another embodiment of the anodized film forming apparatus according to the invention.

FIG. 4 is a cutaway perspective view showing another embodiment of the anodized film forming apparatus of the present invention, mounted on the surface of the cathode.

In this apparatus, electrolytic agent retaining means 16 is a box-shaped container, which has an aperture 16*a* on one side. The aperture 16*a* is located in sliding contact with or in close vicinity to the surface 3*a* of the rotating cathode 3 in a liquid-tight manner. Thus, those regions of the container 16 in which opposite side portions 16*b* and 16*c* thereof are located in sliding contact with or in close vicinity to the cathode surface 3*a* are each in the form of a curved surface having the same curvature as the surface 3*a*.

Preferably, the container 16 is formed of a material, such as polyvinyl chloride or polypropylene, which is resistant to the electrolytic agent.

An electrode 17 for electrolytic oxidation, formed of, e.g., titanium or stainless steel, is disposed in the container 16. The electrode 17 faces the surface 3*a* of the rotating cathode 3 which is exposed to the inside of the container 16 through the aperture 16*a*.

An electrolytic agent supply pipe 18*a* is attached to a side wall of the container 16, and an electrolytic agent discharge pipe 18*b* to the top wall. The pipes 18*a* and 18*b* constitute electrolytic agent supply means 18. The electrolytic agent for the formation of the anodized film is fed through the supply pipe 18*a* into the container 16 to fill it, covers the surface 3*a* of the rotating cathode 3, and then flows out of the system through the discharge pipe 18*b*.

The surface 3*a* of the rotating cathode 3 exposed through the aperture 16*a* of the container 16 can be anodized by supplying current between the electrode 17 and the cathode 3 while causing the electrolytic agent to flow in the container 16.

If the container 16 is mounted so that a narrow clearance is formed between the aperture 16*a* of the container 16 and the surface 3*a* of the rotating cathode 3, some of the supplied electrolytic agent flows out of the clearance along the cathode surface 3*a*. In this process, a uniform-thickness film of the electrolytic agent is formed on the cathode surface 3*a* which is exposed to the aperture 16*a*, so that the conditions for the formation of the anodized film are stabilized.

Figure 5:
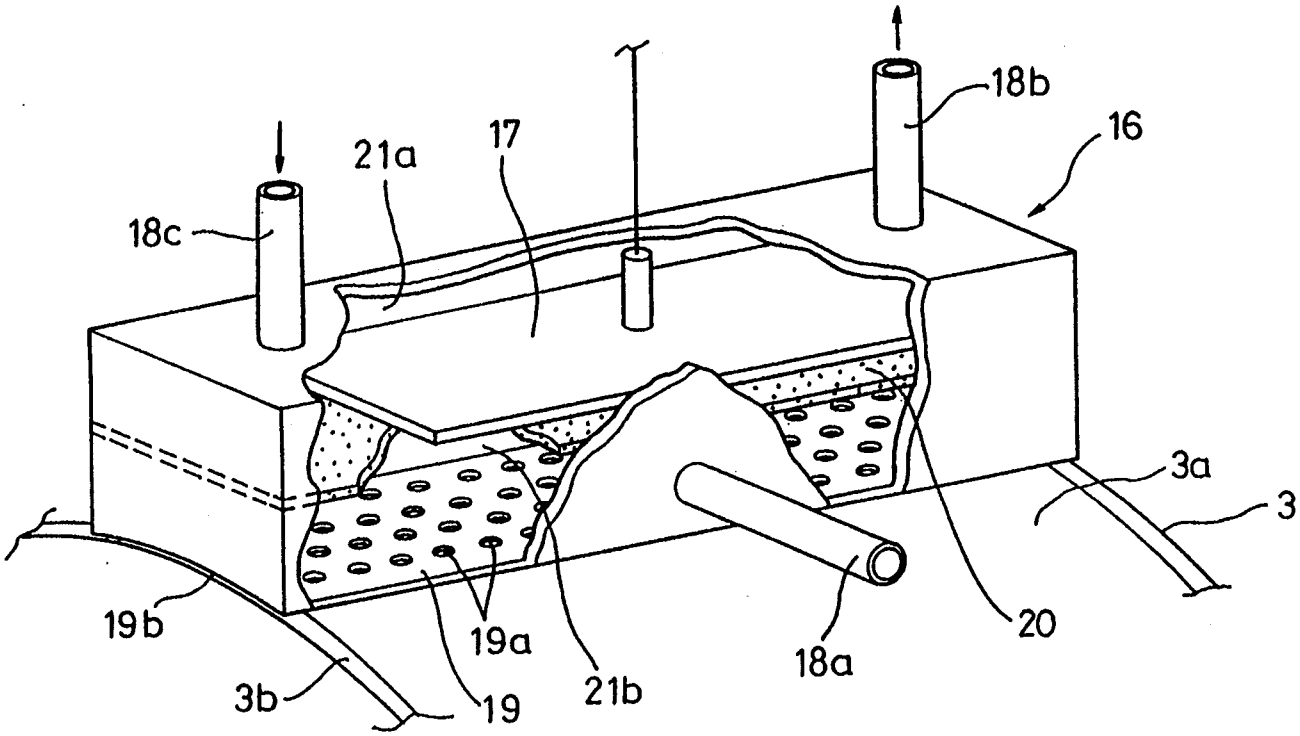
FIG. 5 is a cutaway perspective view showing an improvement of the apparatus of FIG. 4.

FIG. 5 is a cutaway perspective view showing still another embodiment of the anodized film forming apparatus of the present invention, mounted on the surface of the rotating cathode.

According to this apparatus, the aperture 16*a* of the container 16 shown in FIG. 4 is covered by a porous plate 19 which is penetrated by a plurality of electrolytic agent jets 19*a* and has a curved surface with the same curvature as the surface 3*a* of the rotating cathode 3. A metallic powder removing filter 20 is located substantially in the center of the container 16, whereby the interior of the container 16 is divided into two spaces 21*a* and 21*b*, upper and lower. The electrode 17 is situated in the upper space 21*a*.

The electrolytic agent is supplied to the upper space 21*a* through a supply pipe 18*c*, and flows out through the discharge pipe 18*b*. On the other hand, the electrolytic agent is supplied to the lower space 21*b* through the supply pipe 18*a*, and spouts against the surface 3*a* of the rotating cathode 3 through the jets 19*a* in the porous plate 19. Thereupon, a uniform- thickness film of the electrolytic agent is formed on the cathode surface 3*a*.

This apparatus is serviceable when the electrolytic agent is the electrolytic solution used for the manufacture of the metal foil.

If the electrolytic solution used for the manufacture of the metal foil is pumped up to be used directly as the electrolytic agent for anodization, the metal contained in the solution sometimes may be electrodeposited on the surface of the electrode 17 as the anodized film is formed. Depending on the conditions for the film formation, moreover, the metal may be deposited extraordinarily in the form of powder. The metallic powder on the electrode 17 may possibly be swept away from its surface by the flow of the supplied electrolytic agent, and moved to the surface 3*a* of the rotating cathode 3 on which the anodized film is being formed.

In such a case, the metallic powder forms an eutectic on the surface 3*a* of the rotating cathode 3, whereupon bumpy tissues are produced in the formed anodized film.

In the case of this apparatus, however, even though the metallic powder is deposited extraordinarily and leaves the surface of the electrode 17, it is seized or intercepted by the metallic powder removing filter 20. Therefore, the metallic powder never moves to the side of the lower space 21*b*, that is, toward the surface 3*a* of the rotating cathode 3.

The metallic powder removing filter 20 may be formed of a film having fine pores, an ion-exchange resin film, or a microporous film or corrosion-resisting cloth which is impervious to the metallic powder and permeable to metal ions.

If the filter is formed of the ion-exchange resin film, it serves to prevent electrodeposition of metal on the electrode 17.

In this case, the mode of electrolytic solution supply may be changed so that the electrolytic solution for the manufacture of the metal foil is supplied directly as the electrolytic agent to the upper space 21*a*, and an electrolytic solution having a different composition or containing no metal ions is supplied to the lower space 21*b*.

The container 16 may be mounted in a manner such that the surface 3*a* of the rotating cathode 3 and an end portion 19*b* of the porous plate 19 are in sliding contact with each other, or that a narrow clearance is formed between the surface 3*a* and the plate 19.

In the case of the former arrangement, plate- or ring-shaped end members 3*b* of an insulating material are attached individually to the opposite side portions of the surface 3*a* of the rotating cathode 3 so that they are in sliding contact with their corresponding end portions of the porous plate 19. By doing this, a narrow clearance is formed between the remaining portion of the porous plate 19 and the cathode surface 3*a*. Alternatively, foamed plastic or other material which is excellent in abrasion resistance, lubricity, and elasticity may be attached to each end portion of the apparatus itself.

In the case of the latter arrangement, the electrolytic agent ejected from the jets 19*a* forms an electrolytic solution film, which has a uniform thickness equivalent to the clearance, on the cathode surface 3*a*.

The peripheral edge of the porous plate 19, which may sometimes be brought into sliding contact with the cathode surface 3*a*, should preferably be formed of polyethylene, polyester, polyurethane, or silicone rubber, which has high abrasion resistance, lubricity, and elasticity.

Figure 6:
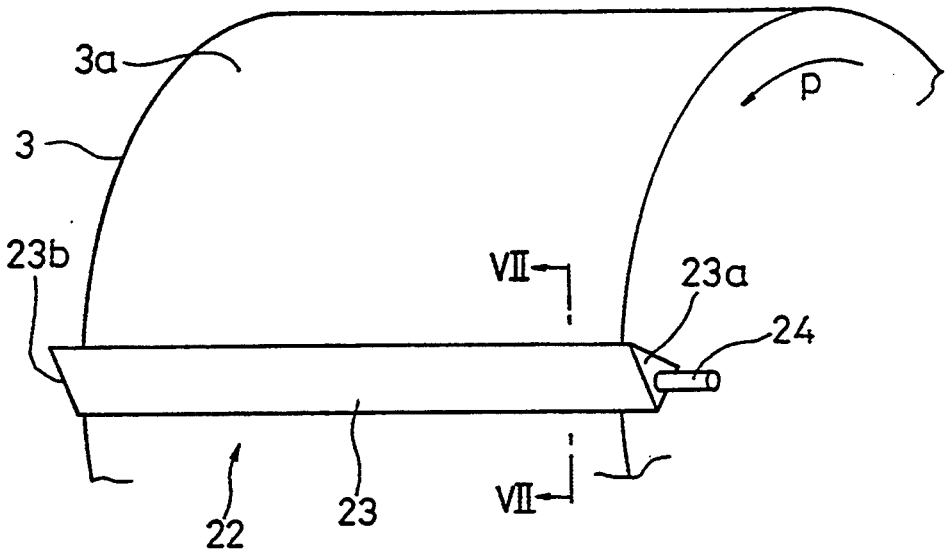
FIG. 6 is a cutaway perspective view showing still another embodiment of the anodized film forming apparatus according to the invention.
Figure 7:
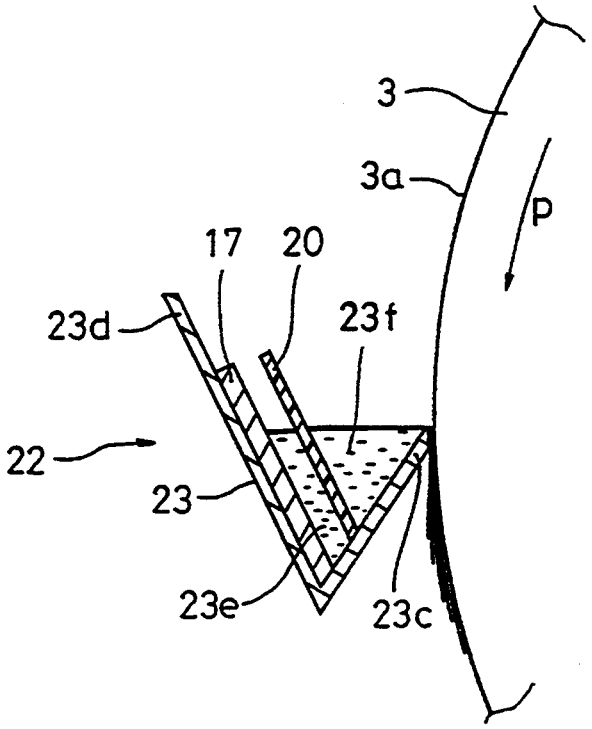
FIG. 7 is a sectional view taken along line VII—VII of FIG. 6.

FIGS. 6 and 7 show a further embodiment of the apparatus according to the invention, mounted on the surface of the rotating cathode. FIG. 7 is a sectional view taken along line VII—VII of FIG. 6.

In this apparatus 22, electrolytic agent retaining means 23 is an elongate trough-shaped container. The container 23 is open-topped, and its opposite end portions 23*a* and 23*b* in the longitudinal direction are sealed. An electrolytic agent supply pipe 24 is attached to the end portion 23*a*, thus constituting electrolytic agent supply means. One side 23*c* of the container 23 is lower in height level than the other side 23*d*.

The trough-shaped container 23 is mounted in a manner such that its longitudinal direction is in line with the width direction of the rotating cathode 3, and that a narrow clearance is formed between its one side 23*c* and the surface 3*a* of the cathode 3.

The electrode 17 for anodization is located on the other side 23*d* of the trough-shaped container 23. For the same reason for the case of the apparatus shown in FIG. 5, moreover, the same metallic powder removing filter 20 as aforesaid is interposed between the electrode 17 and the cathode surface 3*a*. Thus, the interior of the container 23 is divided in two, a space 23*e* in which the electrode 17 is disposed and a space 23*f* being positioned on the cathode-surface side.

After filling the trough-shaped container 23, the electrolytic agent fed through the supply pipe 24 into the container 23 overflows the one side 23*c*, and flows down along the surface 3*a* of the cathode 3 which is rotating in the direction indicated by arrow p. In this process, a uniform-thickness film of the electrolytic agent is continuously formed on the cathode surface 3*a*.

The electrolytic solution for the manufacture of the metal foil may be used directly as the electrolytic agent. Alternatively, however, electrolytic agent supply pipes may be attached individually to the spaces 23*e* and 23*f* in the trough-shaped container 23 so that the electrolytic solution for the manufacture of the metal foil and an electrolytic solution having a different composition or containing no metal ions can be supplied to the spaces 23*a* and 23*f*, respectively, through these pipes.

The cross section of the trough-shaped container 23 is not limited to the shape of a triangle, such as the one shown in FIGS. 6 and 7, and may have the shape of a polygon, e.g., tetragon or hexagon, or a semicircle. In short, the container 23 must only be shaped so that the electrolytic solution therein can overflow its one side 23*c* to form a liquid film on the surface 3*a* of the rotating cathode 3.

Figure 8:
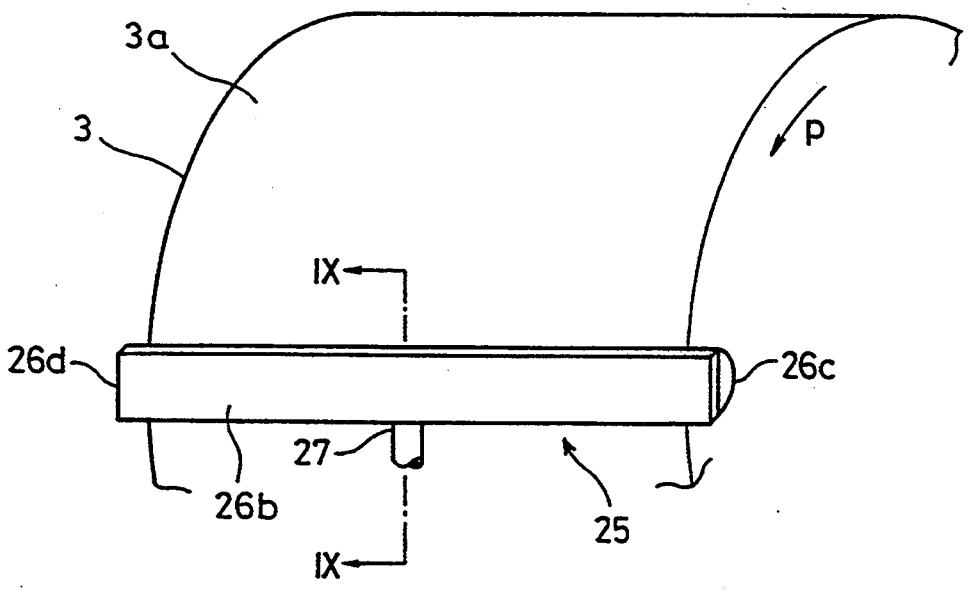
FIG. 8 is a cutaway perspective view showing a further embodiment of the anodized film forming apparatus according to the invention.
Figure 9:
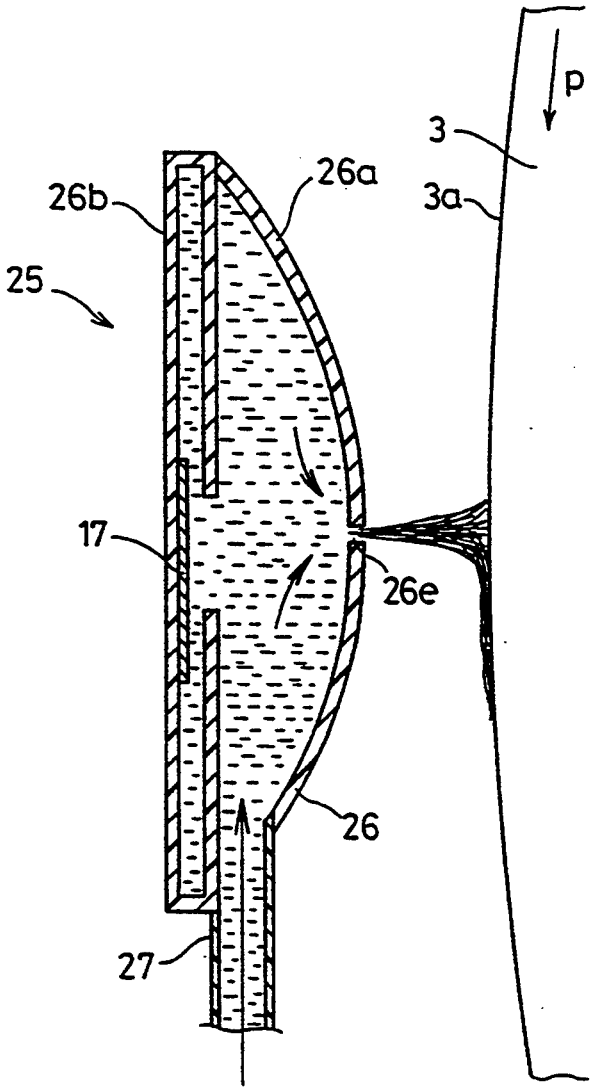
FIG. 9 is a sectional view taken along line IX—IX of FIG. 8.

FIGS. 8 and 9 show a further embodiment of the apparatus according to the invention, mounted on the surface of the rotating cathode. FIG. 9 is a sectional view taken along line IX—IX of FIG. 8.

In this apparatus 25, electrolytic agent retaining means 26 is an elongate closed container having a convex-lens-shaped cross section.

In this closed container 26, an anodization electrode mounting portion 26*b* is mounted on the back of a curved plate 26*a* in a liquid-tight manner, and opposite end portions 26*c* and 26*d* with respect to the longitudinal direction are sealed. An electrolytic agent supply pipe 27 is attached to a substantially central portion of the container 26, and electrolytic solution jet means 26*e* is formed in the top end portion of the curved plate 26*a*. The jet means 26*e* may be formed of, for example, a plurality of holes arranged in the longitudinal direction of the plate 26*a* or a slit having a predetermined width and extending in the longitudinal direction of the plate 26*a*.

The electrode 17 is set on the mounting portion 26*b*, and the whole container is located so that its longitudinal direction is in line with the width direction of the rotating cathode 3, and that the jet means 26*e* formed in the curved plate 26*a* faces the surface 3*a* of the cathode 3 with a predetermined space between them.

The electrolytic agent fed through the supply pipe 27 into the container 26 by pumping or the like spouts from the jet means 26*e* after filling the container 26, runs against the surface 3*a* of the cathode 3 rotating in the direction of arrow p, and flows down along the surface 3*a*, thereby forming a liquid film having a uniform thickness.

The surface 3*a* of the rotating cathode 3 is anodized by applying a predetermined voltage between the cathode 3 as a positive electrode and the electrode 17 as a negative electrode while maintaining this state. Since the cathode 3 is rotating in the direction indicated by arrow p in FIG. 8, an anodized film is formed continuously or intermittently on the surface 3*a*.

Although that surface which is opposed to the surface 3*a* of the rotating cathode 3 is curved in this apparatus, it is not limited to this shape, and must only be shaped so that the electrolytic agent filling the container 26 can spout against the cathode surface 3*a*. Also, the container 26 may be provided with means for uniformly dispersing the electrolytic agent therein, e.g., uniform small holes bored through the wall of a pipe such that the electrolytic agent can be fed into the pipe to be ejected from the small holes. Moreover, the supply pipe 27 need not necessarily be located in the central portion of the apparatus 25, and may be situated in any other position provided that the electrolytic agent can be uniformly ejected through the jet means 26*e*.

Furthermore, the same metallic powder removing filter as aforesaid may be interposed between the electrode 17 and the jet means 26*e* so that metallic powder electrodeposited on the electrode can be prevented from flowing Out onto the surface 3*a* of the rotating cathode 3.

When using the electrolytic solution for the manufacture of the metal foil, which has a relatively high metal concentration, as the electrolytic agent in this apparatus, the consumption of the electrolytic solution in the anodization can be reduced by minimizing the size of the jet(s) of the jet means 26*e*. By doing this, moreover, the scattering of the electrolytic solution can be reduced to restrain the metallic salt in the used electrolytic solution to the utmost from being deposited.

A water solution of copper sulfate with a relatively high copper concentration is used as the electrolytic solution for the manufacture of an electrolytic copper foil, for example. If this electrolytic solution is used as the electrolytic agent for anodization, however, a copper sulfate crystal is precipitated and adheres to the apparatus or the copper foil, possibly hindering smooth operation of the apparatus, when the temperature is lowered. Conventionally, therefore, in the apparatus shown in FIGS. 8 and 9, the aforesaid awkward situation is avoided by changing the shape of the jet means 26*e* and the distance to the cathode surface 3*a*.

EXAMPLE 1

In the electrolytic copper foil manufacturing apparatus shown in FIG. 2, a titanium drum of 3,000-mm diameter and 1,500-mm width was used as the rotating cathode 3. The surface of this drum was buffed.

Subsequently, the stainless-steel pipe 13 of 250-mm diameter and 1,500-mm length was covered by means of the polyester felt 14 of 10-mm thickness. The felt 14 was brought into contact with the ground surface 3*a* of the titanium drum 3, and the polyvinyl chloride pipe 15 of 30-mm diameter, penetrated by the apertures 15*b* of 2-mm diameter arranged at intervals of 10 mm, was located over the polyester felt 14.

The pipe 15 was supplied with a 10 g/l water solution of sulfuric acid (temperature: 50° C.) as the electrolytic agent for anodization, which flowed down through the apertures 15*b* onto the polyester felt 14. As the titanium drum 3 was rotated, the electrolytic voltage between the drum 3 and the terminals 13*a* was kept constant, and an initial anodization process (total anodization time: 3 seconds) for three revolutions of the drum was executed so that an oxide film with a thickness of about 28 angstroms were obtained.

The surface of the titanium drum 3 changed its color to a uniform, relatively pale golden color, and formation of an anodized film of titanium oxide on the drum surface was confirmed. Thereafter, the electrolytic voltage was fixed to 0.5 V, and anodization was executed continuously.

Then, the surface 3*a* of the titanium drum 3 was rotated and moved gradually toward the electrolytic apparatus shown in FIG. 2, whereupon copper was deposited on the surface 3*a* to form a thin copper layer thereon by using an electrolytic solution of 55° C. containing 80 g/l of copper, 80 g/l of sulfuric acid, and 2 ppm of glue, under conditions including the current density of 50 A/dm$^2$ and flow rate of 2 m/sec. Thereafter, the copper layer was separated from the drum surface 3*a*, and the electrolytic copper foil 7 of 18-$\mu$m thickness was continuously manufactured without interrupting the continuous anodization at 0.5 V.

During 15 days of this operation, buffing was required at no time.

The obtained electrolytic copper foil was measured for tensile strength (kg/mm$^2$), elongation (%), shiny-side surface roughness (Rz), and bending strength (times). Table 1 shows the results of this measurement.

For comparison, the properties were measured on an electrolytic copper foil obtained by buffing the titanium drum in cycles of 24 hours without anodizing it (Comparative Example 1). Table 1 also shows the results of this measurement.

The thickness of anodized film was measured by means of an auger analyzer. According to this measuring method, it was ascertained that there was a relationship between the electrolytic voltage for anodization and the thickness of the anodized film such that a film with a thickness of about 14 angstroms was formed for each electrolytic voltage of 1 V.

In the following examples, the thickness of the anodized film was measured in like manner.

TABLE 1

| | Tensile*1 strength (kg/mm²) | Elongation*2 (%) | Shiny-side*3 surface roughness (Rz) | Bending*4 strength (times) |
|---|---|---|---|---|
| Example 1 | 38 | 9 | 2 | 180 |
| Comparative Example 1 | 34 | 9 | 2 | 180 |

*1By JISC6511
*2By JISC6511
*3By JISB0601
*4By JISP8115

As seen from the data on Table 1, the electrolytic copper foil manufactured by the method of the present invention is higher in tensile strength than the conventional one, and is a useful copper foil for a copper-clad laminate.

In Example 1, the anodized film was formed continuously. When anodization was carried out intermittently for each revolution of the drum at intervals of 1 hour, 6 hours, and 12 hours by using an automatic timer, on the other hand, the resulting electrolytic copper foil exhibited the same properties as the copper foil of Example 1.

As another comparative example, the same electrolytic copper foil as that of Example 1 was continuously manufactured with use of a 20 g/l water solution of sulfuric acid at the electrolytic voltage for anodization of 0.5 V (corresponding to the film thickness of 7 angstroms) (Comparative Example 2). In 7 days after the start of operation, it was necessary that the drum surface be buffed.

Subsequently, an influence of the thickness of the anodized film upon the characteristics of the copper foil was examined.

In Example 1, anodized films with different thicknesses were formed on the drum surface at a different electrolytic voltage for the initial stage of anodized film formation. In each case, an electrolytic copper foil of 18-μm thickness was continuously manufactured under the same conditions as in Example 1.

Each obtained electrolytic copper foil was measured for tensile strength (kg/mm²), elongation (%), shiny-side surface roughness (Rz), and number of pinholes for each copper foil area of 10 m². Table 10 shows the results of this measurement compared with the thickness of the initial anodized film.

Figure 10:
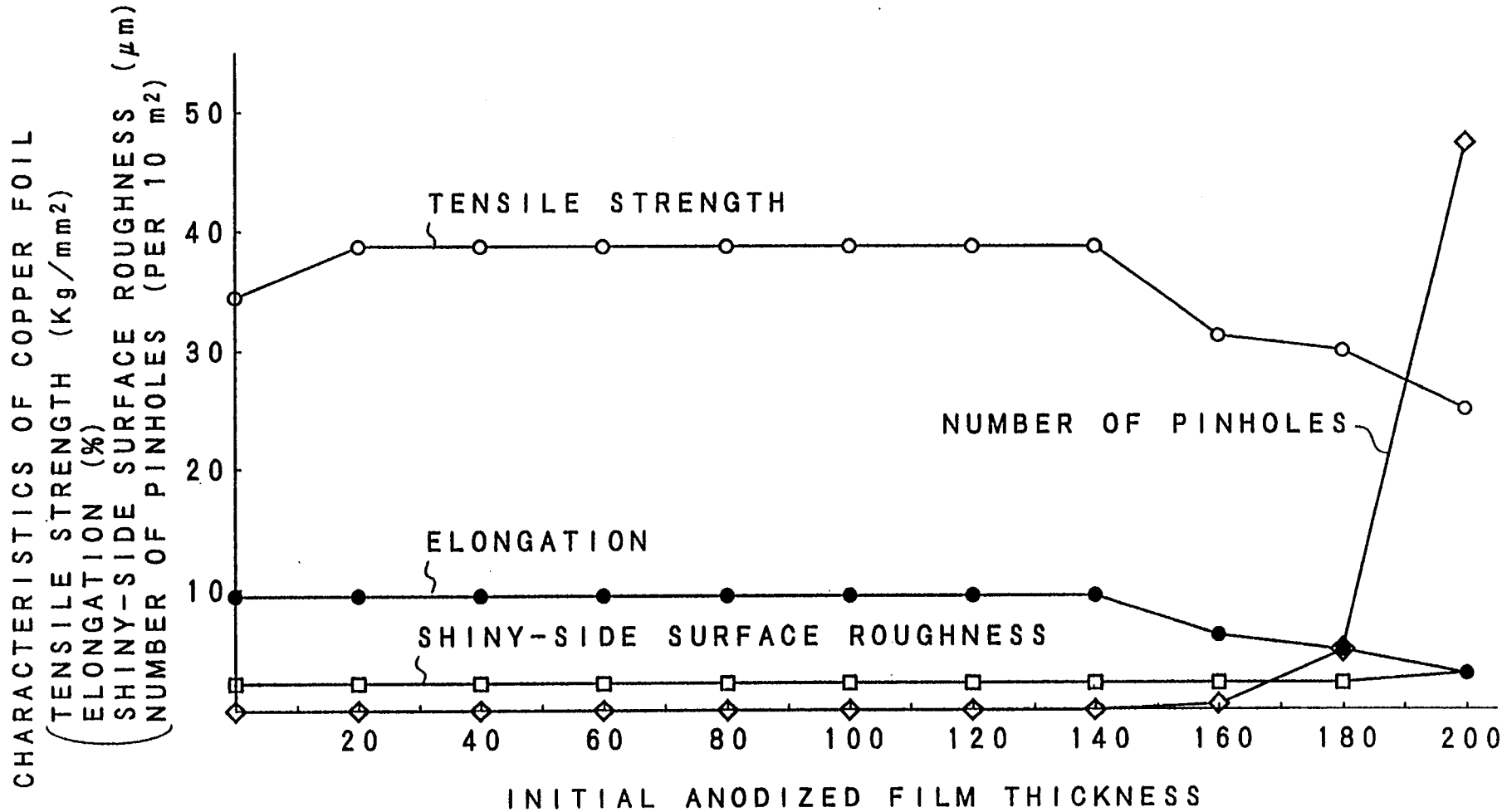
FIG. 10 is a graph illustrating the relationships between the thickness of an anodized film and the characteristics of a copper foil.

If the initial anodized film is thicker than 140 angstroms, as seen from FIG. 10, the tensile strength and elongation of the obtained electrolytic copper foil lower, and more pinholes are produced.

EXAMPLE 2

An electrolytic copper foil of 35-μm thickness was continuously manufactured in the same manner as in Example 1 without changing the electrolytic voltage for anodization fixed to 0.5 V, except for the variation of the following conditions. A polyvinyl chloride pipe of 200-mm thickness covered by a copper foil of 68-μm thickness was used in place of the stainless-steel pipe 13. A 1 g/l water solution of sulfuric acid (temperature: 60° C.) was used as the electrolytic agent 15*a* for anodization. The diameter of the apertures 15*b* of the pipe 15 was 2.5 mm. The electrolytic voltage for anodization (total anodization time: 6 seconds) for three revolutions of the drum was fixed to 5 V (corresponding to the anodized film thickness of about 70 angstroms). The electrolytic solution for copper electrodeposition contained 100 g/l of copper, 100 g/l of sulfuric acid, and 3 ppm of glue, and its temperature was 60° C. As for the conditions for the copper electrodeposition, the current density and the flow rate were 60 A/dm² and 2 m/sec, respectively.

During a month of this operation, buffing was required at no time.

The obtained electrolytic copper foil was measured for tensile strength (kg/mm²), elongation (%), shiny-side surface roughness (Rz), and bending strength (times). Table 2 shows the results of this measurement.

For comparison, the properties were measured on an electrolytic copper foil obtained by buffing the titanium drum in cycles of 40 hours without anodizing it (Comparative Example 3).

As another comparative example, an electrolytic copper foil of 35-μm thickness was continuously manufactured in the same manner as in Example 2 except for the electrolytic voltage for anodization fixed to 15 V (corresponding to the anodized film thickness of 210 angstroms) (Comparative Example 4). Table 2 also shows the results of this measurement.

TABLE 2

| | Tensile strength (kg/mm²) | Elongation (%) | Shiny-side surface roughness (Rz) | Bending strength (times) |
|---|---|---|---|---|
| Example 2 | 35 | 10 | 2 | 40 |
| Comparative Example 3 | 31 | 10 | 2 | 40 |
| Comparative Example 4 | 27 | 7 | 2 | 30 |

As seen from the data on Table 2, the electrolytic copper foil manufactured under the conditions of Example 2 is also higher in tensile strength than the conventional ones, and is a useful copper foil for a copper-clad laminate.

In Example 2, the anodized film was formed continuously. When 0.5-V anodization was carried out intermittently for each revolution of the drum at intervals of 12 hours and 24 hours by using the automatic timer, on the other hand, the resulting electrolytic copper foil exhibited the same properties as the copper foil of Example 2.

EXAMPLE 3

In the apparatus shown in FIG. 3, an electrolytic copper foil of 70-μm thickness was continuously manufactured under the same conditions as in Example 2, except for the variation of the following conditions. The diameter of the polyvinyl chloride pipe 13 was 150 mm, and the diameter of the apertures 15*b* of the pipe 15 was 1.5 mm. The electrolytic voltage for anodization (total anodization time: 12 seconds) for initial three revolutions of the drum was fixed to 10 V (corresponding to the anodized film thickness of about 140 angstroms). As for the conditions for copper electrodeposition, the current density and the flow rate were 70 A/dm² and 3 m/sec, respectively.

During a month of this operation, buffing was required at no time.

The obtained electrolytic copper foil was measured for tensile strength (kg/mm²), elongation (%), shiny-side surface roughness (Rz), and bending strength (times). Table 3 shows the results of this measurement.

For comparison, the properties were measured on an electrolytic copper foil obtained by buffing the titanium drum in cycles of 50 hours without anodizing it (Comparative Example 5). Table 3 also shows the results of this measurement.

TABLE 3

| | Tensile strength ($kg/mm^2$) | Elongation (%) | Shiny-side surface roughness (Rz) | Bending strength (times) |
|---|---|---|---|---|
| Example 3 | 32 | 14 | 2 | 20 |
| Comparative Example 5 | 29 | 14 | 2 | 20 |

As seen from the data on Table 3, the electrolytic copper foil manufactured under the conditions of Example 3 is also higher in tensile strength than the conventional one, and is a useful copper foil for a copper-clad laminate.

In Example 3, the anodized film was formed continuously. When 1-V anodization was carried out intermittently for each revolution of the drum at intervals of 12 hours and 24 hours by using the automatic timer after having effected 10-V anodization for three revolutions of the drum, on the other hand, the resulting electrolytic copper foil exhibited the same properties as the copper foil of Example 3.

As another comparative example, the water solution of sulfuric acid used in Example 3 was filled into an electrolytic cell which is separate from the one used for the manufacture of the electrolytic copper foil, the drum with the buffed surface was immersed in the solution, and anodization was carried out with the electrolytic voltage fixed to 10 V. After the anodization, the drum was set in the electrolytic cell for the manufacture of the electrolytic copper foil, and an electrolytic copper foil was continuously manufactured in the same manner as in Example 3 (Comparative Example 6).

In the case of Example 3, the anodization and the manufacture of the electrolytic copper foil can be executed continuously. In the case of Comparative Example 6, however, the manufacture of the electrolytic copper foil must inevitably be interrupted for 24 hours for the transfer of the drum to the electrolytic cell for this purpose after the anodization.

EXAMPLE 4

In the anodized film forming apparatus of Example 1, an electrolytic copper foil of 12-μm thickness was continuously manufactured in the same manner as in Example 1 without interrupting the continuous anodization with the electrolytic voltage fixed to 0.1 V, except for the variation of the following conditions. The diameter of the apertures 15*b* of the pipe 15 was 3 mm. The operating electrolytic voltage (total anodization time: 2.5 seconds) for four revolutions of the cathode drum surface for continuous oxidation was fixed to 1 V (corresponding to the anodized film thickness of about 14 angstroms). Moreover, the same electrolytic conditions for the copper electrodeposition of Example 1 were used.

During a week of this operation, buffing was required at no time.

The obtained electrolytic copper foil was measured for tensile strength ($kg/mm^2$), elongation (%), shiny-side surface roughness (Rz), and bending strength (times). Table 4 shows the results of this measurement.

For comparison, the properties were measured on an electrolytic copper foil obtained by buffing the titanium drum in cycles of 24 hours without anodizing it (Comparative Example 7). Table 4 also shows the results of this measurement as Comparative Example 7.

Also, an anodized film was previously formed on the drum surface by anodization with the electrolytic voltage of 1 V in another electrolytic cell for anodization, the titanium drum was set on a copper foil production line, and an electrolytic copper foil of 12-μm thickness was manufactured under the same conditions as in Example 4.

After about 3 hours of operation, the separability of the electrolytic copper foil were worsened, the stripping tension of the copper foil became partially nonuniform, and the resulting copper foil was subject to wrinkles. Thereupon, removal of the drum from the production line and another process of anodizing the drum surface were needed.

When the drum surface was previously anodized outside the production line in this manner, the anodization process had to be executed every three hours, so that the length of the electrolytic copper foil manufactured by one cycle of continuous operation was only about 600 m. Thus, an elongate copper foil was not able to be manufactured continuously, so that the productivity, as well as the operating efficiency, was lowered. Table 4 also shows the properties of the obtained electrolytic copper foil as Comparative Example 8.

TABLE 4

| | Tensile strength ($kg/mm^2$) | Elongation (%) | Shiny-side surface roughness (Rz) | Bending strength (times) |
|---|---|---|---|---|
| Example 4 | 40 | 7 | 2 | 380 |
| Comparative Example 7 | 34 | 7 | 2 | 380 |
| Comparative Example 8 | 34~40 | 7 | 2 | 380 |

EXAMPLE 5

The anodized film forming apparatus shown in FIG. 5 was mounted on the buffed surface 3*a* of the titanium drum 3 in a manner such that the clearance between the porous plate 19 and the surface 3*a* was 1 mm. The electrode 17 was a stainless-steel plate, and the metallic powder removing filter 20 was formed of a microporous film having distributed pores of 1-μm thickness.

The electrolytic solution used in Example 1 was supplied as the electrolytic agent to the upper space 21*a* through the supply pipe 18*c*, and then discharged through the discharge pipe 18*b* to be returned to the electrolytic cell. Further, the electrolytic solution supplied through a filter was fed to the lower space 21*b* via the supply pipe 18*a*, and ejected against the surface 3*a* of the rotating cathode 3 through the jets 19*a* of the porous plate 19, thus forming an electrolytic solution film on the surface 3*a*.

In this state, anodization was carried out with the electrolytic voltage between the titanium drum 3 and the stainless-steel plate (electrode) 17 fixed to 2 V so that an anodized film with a thickness of about 28 angstroms was able to be obtained. Subsequently, an electrolytic copper foil of 35-μm thickness was formed on this anodized film under the same conditions as in Example 1.

During a month of this operation, buffing was required at no time.

The obtained electrolytic copper foil was measured for tensile strength (kg/mm$^2$), elongation (%), shiny-side surface roughness (Rz), and bending strength (times). Table 5 shows the results of this measurement.

For comparison, the properties were measured on an electrolytic copper foil obtained by buffing the titanium drum in cycles of 48 hours without anodizing it (Comparative Example 9). Table 5 also shows the results of this measurement.

TABLE 5

| | Tensile strength (kg/mm$^2$) | Elongation (%) | Shiny-side surface roughness (Rz) | Bending strength (times) |
|---|---|---|---|---|
| Example 5 | 35 | 10 | 2 | 40 |
| Comparative Example 9 | 31 | 10 | 2 | 40 |

EXAMPLE 6

In the apparatus of Example 5, the apparatus 16 and the surface 3*a* of the titanium drum were brought into sliding contact with each other with a flexible foamed polyethylene sheet interposed between the end portion 19*b* of the porous plate 19 and drum surface 3*a*, using an anion-exchange resin film (AMH of high-temperature type from Tokuyama Soda Co., Ltd.) as the metallic powder removing filter 20.

The supplied electrolytic solution hardly underwent any leakage, and was able to be utilized effectively.

A 1 g/l water solution of sulfuric acid was pumped for circulation into the upper space 21*a* through the supply pipe 18*c*, while an electrolytic solution of 65° C. for the manufacture of the electrolytic copper foil, containing 100 g/l of copper, 90 g/l of sulfuric acid, and 4 ppm of glue, was supplied to the lower space 21*b* through the supply pipe 18*a*. Then, anodization was carried out with the electrolytic voltage between the titanium drum 3 and the stainless-steel plate 17 fixed to 5 V so that an anodized film with a thickness of about 70 angstroms was able to be obtained. Subsequently, the electrolytic solution was used to form an electrolytic copper foil of 35-μm thickness on this anodized film under conditions including the current density of 50 A/dm$^2$ and flow rate of 1 m/sec.

Buffing was required at no time during about 15 days of continuous manufacture of the electrolytic copper foil after anodization of the surface 3*a* of the titanium drum (total anodization time: 4 seconds) for two revolutions of the drum.

The obtained electrolytic copper foil was measured for tensile strength (kg/mm$^2$), elongation (%), shiny-side surface roughness (Rz), and bending strength (times). Table 6 shows the results of this measurement.

For comparison, the properties were measured on an electrolytic copper foil obtained by buffing the titanium drum in cycles of 48 hours without anodizing it (Comparative Example 10). Table 6 also shows the results of this measurement.

TABLE 6

| | Tensile strength (kg/mm$^2$) | Elongation (%) | Shiny-side surface roughness (Rz) | Bending strength (times) |
|---|---|---|---|---|
| Example 6 | 35 | 10 | 2 | 40 |
| Comparative Example 10 | 31 | 10 | 2 | 40 |

EXAMPLE 7

The respective lateral portions of a heatproof polyvinyl chloride sheet 1,500 mm long, 30 mm wide, and 5 mm thick and another heatproof polyvinyl chloride sheet 1,500 mm long, 50 mm wide, and 5 mm thick were welded together in the longitudinal direction, and a similar polyvinyl chloride sheet was welded to each end portion of the resulting structure. Thus, a trough-shaped container 23 having a triangular cross section, such as the one shown in FIG. 7, was fabricated.

The stainless-steel electrode 17 was located on the other side 23*d* of the trough-shaped container 23. The container 23 was mounted in close vicinity to the surface 3*a* of the titanium drum without the interposition of the metallic powder removing filter 20, as shown in FIGS. 6 and 7. The electrolytic solution of Example 5 was supplied to the container 23, and anodization was carried out with the constant electrolytic voltage of 0.5 V in a manner such that the solution overflowed the one side 23*c* of the container, whereupon an anodized film of 7-angstrom thickness was formed. Subsequently, an electrolytic copper foil of 18-μm thickness was formed on this anodized film under the same conditions as in Example 1.

During a month of this operation, buffing was required at no time. The mechanical characteristics of the resulting electrolytic copper foil were substantially the same as those of the electrolytic copper foil obtained in Example 1.

EXAMPLE 8

An anodized film and an electrolytic copper foil were formed in the same manner as in Example 7 except that a microporous film having distributed pores of 1-μm thickness was interposed as the metallic powder removing filter 20 between the electrode 17 and the surface 3*a* of the titanium drum.

During a month of this operation, buffing was required at no time. The mechanical characteristics of the resulting electrolytic copper foil were substantially the same as those of the electrolytic copper foil obtained in Example 1.

EXAMPLE 9

The closed container 26 shown in FIGS. 8 and 9 was manufactured in a manner such that the slit 26*e* 2 mm wide and 1,400 mm long was formed extending longitudinally in the top end portion of the curved plate 26*a* of a heatproof polyvinyl chloride sheet 1,500 mm long, 200 mm wide, and 100 mm thick, and the supply pipe 27 of 25-mm diameter was attached to the plate 26*a*. A copper plate 1,400 mm, 100 mm wide, and 1 mm thick for use as the electrode 17 was located in the container 26.

The container 26 was mounted on a buffed titanium drum 3 with the same size and shape as that of Example 1 in a manner such that the slit 26e faced the drum surface.

After the electrolytic solution used in Example 1 was fed through the supply pipe 27 into the container 26 to fill it up, it was ejected from the slit 26e toward the surface 3a of the titanium drum 3, thereby forming an electrolytic solution film on the drum surface.

In this state, the electrolytic voltage was kept at 5 V by means of a DC regulated power source, and an electrolytic copper foil of 68-μm thickness was manufactured for 24 hours as 2-V anodization (total anodization time: 8 seconds) for three revolutions of the titanium drum was carried out. After this, 2-V anodization was carried out for three revolutions (total anodization time: 12 seconds). Without changing the electrolytic voltage fixed to 0.5 V, thereafter, an electrolytic copper foil of 18-μm thickness was manufactured in the same conditions as in Example 1.

During two weeks of this operation, buffing was required at no time. The resulting copper foil enjoyed the same performance as that of Example 1.

As is evident from the above description, the anodized film formed on the surface of the cathode by the method according to the present invention serves as a uniform, corrosion-resisting protective film. During the manufacture of the metal foil, therefore, the metal foil can be effectively prevented from suffering tissue defects, such as surface unevenness, pinholes, etc., as a nonuniform oxide film is formed on the cathode surface. Thus, a good-quality metal foil can be manufactured.

Moreover, the necessity of the conventional short-cycle buffing of the cathode surface is obviated, so that the costs of material and operation associated with the buffing work can be cut. Also, the cathode itself wears less, so that it can enjoy a longer working life, and requires replacement less frequently. Thus, the productivity for the metal foil can be improved.

If the cathode and the electrode of the anodized film forming apparatus are a rotating drum and a conductive roll, respectively, as described in connection with Examples 1 to 4, the roll can automatically rotate without requiring additional use of any drive means as the drum rotates.

In the case of the anodized film forming apparatus used in association with Examples 5 to 7, moreover, an electrolytic solution for the metal foil production having a relatively high metal ion concentration can be used as the electrolytic agent. If the electrolytic solution gets into the electrolytic cell for manufacture of the metal foil, it arouses no awkward problems on account of its homogeneity, so that any solution mixture preventive means need not be provided in particular. It is unnecessary, furthermore, to prepare any other electrolytic solution for the formation of the anodized film, and the electrolytic solution can be removed directly from the electrolytic cell when it is to be used. Also, electrodeposition of the metal on the electrode can be prevented by interposing an ion-exchange resin film between the electrode and the cathode surface. As in the case where the conductive roll is used, moreover, the metallic powder generated from the electrode, which has a bad influence upon the manufacture of the metal foil, can be prevented from moving toward the cathode.

In the case of the apparatus used in Example 9, furthermore, even though the electrolytic solution for the metal foil production is used as the electrolytic agent for anodization, its jet flow rate can be reduced by narrowing the slit width, and the area of the cathode for the jet flow can be minimized. Accordingly, no metallic salt from the electrolytic solution is deposited on the surface of an insulator or the like at the end or peripheral edge portions the cathode. Thus, any metallic salt can be prevented from adhering to the resulting metal foil.

What is claimed is:

1. A metal foil manufacturing method comprising:

(A) immersing an anode and part of a drum-shaped cathode in an electrolytic solution containing metal ion, and supplying current between the anode and the drum-shaped cathode while rotating the drum-shaped cathode, thereby causing an electrolytic reaction; electrodepositing a metal on a surface of the drum-shaped cathode by means of the electrolytic reaction, thereby continuously forming a thin metal layer; and separating the thin metal layer from the surface of the drum-shaped cathode, thereby continuously recovering the thin metal layer as metal foil and leaving an exposed surface of the drum-shaped cathode;

(B) subjecting the exposed surface of the drum-shaped cathode to electrolytic oxidation to form an anodized film thereon, without suspending the manufacture of the metal foil, by supplying an electrolytic agent from a supply means to a retaining means for retaining the electrolytic agent in contact with the exposed surface of the drum-shaped cathode, and an electrode and by setting operating potentials of the anode, the drum-shaped cathode and the electrode such that the operating potential of the drum-shaped cathode is lower than that of the anode and higher than that of the electrode.

2. A metal foil manufacturing method according to claim 1, wherein said metal foil is a copper foil.

3. A metal foil manufacturing method according to claim 1, wherein said electrolytic oxidation is based on a constant-voltage method using an electrolytic voltage of 0.1 to 10 V.

4. A metal foil manufacturing method according to claim 1, wherein the electrolytic oxidation forms said anodized film to a thickness of 1.4 to 140 angstroms.

5. A metal foil manufacturing method according to claim 1, wherein the electrolytic agent used for said electrolytic oxidation is the electrolytic solution used for the manufacture of the metal foil or an electrolytic solution with the same composition and a different ratio of components.

6. A metal foil manufacturing method according to claim 1, wherein the electrolytic agent used for said electrolytic oxidation is an electrolytic solution containing no metal ions to be electrodeposited on the surface of the drum-shaped cathode.

7. A metal foil manufacturing method according to claim 1, wherein the electrolytic agent used for said electrolytic oxidation is an electrolytic solution containing no metal ions.

8. A metal foil manufacturing method according to claim 1, wherein said metal foil is a copper foil, and the electrolytic agent used for said electrolytic oxidation is a water solution of sulfuric acid with a concentration of 10 g/l or less.

9. A metal foil manufacturing method according to claim 1, wherein at least the surface of said drum-shaped cathode is formed of titanium or an alloy of titanium.

10. The method of claim 1 wherein the step of subjecting the drum-shaped cathode to electrolytic oxidation comprises subjecting the exposed surface to continuous electrolytic oxidation.

11. The method of claim 1 wherein the step of subjecting the drum-shaped cathode to electrolytic oxidation comprises subjecting the exposed surface to intermittent electrolytic oxidation.

12. An anodized film forming apparatus used in conjunction with a metal foil manufacturing method which method includes supplying current between an anode, which is entirely immersed in an electrolytic solution containing metal ion, and a drum-shaped cathode partly immersed in the electrolytic solution, to cause an electrolytic reaction and thereby form a thin metal layer on a surface of the drum-shaped cathode, and continuously separating the thin metal layer from the surface of the drum-shaped cathode to recover the metal layer as the foil and leave an exposed portion of the surface of the drum-shaped cathode, the anodized film forming apparatus being mounted at the exposed portion of the surface of the drum-shaped cathode which is exposed as a result of the separation of the thin metal layer from the drum-shaped cathode, the anodized film forming apparatus being operable to continuously or intermittently subject the exposed surface of the drum-shaped cathode to electrolytic oxidation to form an anodized film thereon, the anodized film forming apparatus comprising:

retaining means for retaining an electrolytic agent used for the electrolytic oxidation such that the electrolytic agent is in contact with the exposed surface of the drum-shaped cathode;

an electrode located in the retaining means and facing the exposed surface of the drum-shaped cathode;

supply means for supplying the electrolytic agent to the retaining means; and a controller for controlling operating potentials of the anode, the drum-shaped cathode and the electrode such that the operating potential of the drum-shaped cathode is lower than that of the anode and higher than that of the electrode.

13. An anodized film forming apparatus according to claim 12, wherein said electrode is an electrically conductive roll at least the surface of which is conductive, said electrolytic agent retaining means is formed of fibers or a spongy polymeric material, and said roll is surrounded by the retaining means.

14. An anodized film forming apparatus according to claim 12, wherein said electrolytic agent retaining means is a box-shaped container at least partially open and mounted so that the open side thereof is in sliding contact with or in close vicinity to the exposed surface of the drum-shaped cathode, the electrode being located in the container so as to face the exposed surface of the drum-shaped cathode.

15. An anodized film forming apparatus according to claim 13, wherein said electrolytic agent retaining means is a box-shaped container with an open face having a plurality of holes therein and fitted with a porous plate curved with a curvature equal to that of the exposed surface of the drum-shaped cathode.

16. An anodized film forming apparatus according to claim 14 or 15, wherein a metallic powder removing filter is interposed between the open face portion and the electrode.

17. An anodized film forming apparatus according to claim 13, wherein said electrolytic agent retaining means is an elongated trough-shaped container open-topped and sealed at both end portions thereof, the trough-shaped container being mounted so that the longitudinal direction thereof is in line with the width direction of the drum-shaped cathode and that one side thereof is located in close vicinity to the exposed surface of the drum-shaped cathode, and the electrode being located on the other side of the container, so that the electrolytic agent overflows the one side of the container, thereby forming an electrolytic agent film on the surface of the drum-shaped cathode.

18. An anodized film forming apparatus according to claim 17, wherein a metallic powder removing filter is interposed between the one side of the trough-shaped container and the electrode.

19. An anodized film forming apparatus according to claim 12, wherein said electrolytic agent retaining means is formed of an elongated closed container having the electrode therein and jet means for the electrolytic agent formed on that face thereof opposed the electrode, and said closed container is located so that the jet-side face thereof is in close vicinity to the exposed surface of the drum-shaped cathode, so that the electrolytic agent is ejected against the surface of the drum-shaped cathode from the electrolytic agent jet means.

20. An anodized film forming apparatus according to claim 19, wherein said jet means includes a group of small holes or a slit formed extending in the longitudinal direction of the closed container.

21. An anodized film forming apparatus according to claim 19 or 20, wherein a metallic powder removing filter is interposed between the electrode and the group of small holes or the slit as the jet means.

* * * * *

UNITED STATES PATENT AND TRADEMARK OFFICE

CERTIFICATE OF CORRECTION

PATENT NO. : 5,441,627

DATED : August 15, 1995

INVENTOR(S) : KATO et al

It is certified that error appears in the above-identified patent and that said Letters Patent is hereby corrected as shown below:

Column 22, line 5, Claim 15: replace "13" with --12--.

Column 22, line 16, Claim 17: replace "13" with --12--.

Signed and Sealed this

Twenty-first Day of July, 1998

Bruce Lehman

*Attest:*

BRUCE LEHMAN

*Attesting Officer*

*Commissioner of Patents and Trademarks*